US005078155A

United States Patent [19]

Grandel

[11] Patent Number: 5,078,155

[45] Date of Patent: Jan. 7, 1992

[54] ASHTRAY APPARATUS

[76] Inventor: Robert L. Grandel, 1024B Franklin St., Winchester, Va. 22601

[21] Appl. No.: 610,166

[22] Filed: Nov. 5, 1990

[51] Int. Cl.[5] ..... A24F 19/00

[52] U.S. Cl. ..... 131/231; 131/240.1; 131/241; 131/242; 211/74; 248/105; D9/455

[58] Field of Search ..... D9/455; 248/105, 106; 211/74; 131/231, 174, 240.1, 241, 242

[56] References Cited

U.S. PATENT DOCUMENTS

| | | | |
|---|---|---|---|
| 1,829,353 | 10/1931 | Hogan | 248/105 X |
| 4,093,076 | 6/1978 | Newton | 211/74 |
| 4,285,449 | 8/1981 | Campos | 211/74 X |

FOREIGN PATENT DOCUMENTS

| | | | |
|---|---|---|---|
| 457995 | 7/1949 | Canada | 248/105 |
| 4652 | of 1897 | United Kingdom | 248/105 |

*Primary Examiner*—V. Millin
*Assistant Examiner*—J. Doyle
*Attorney, Agent, or Firm*—Leon Gilden

[57] ABSTRACT

An ashtray apparatus mounting a disposable bottle is provided, wherein the organization includes a forward and rear mounting block, with each mounting block including an aligned semi-cylindrical saddle to receive the bottle thereon. The bottle includes a first diameter and a forward end, with an opening of a second reduced diameter to receive a cigarette therewithin, wherein the cigarette is permitted to extinguish within the bottle upon prolonged positioning within the bottle permitting subsequent disposal of the bottle and cigarette debris. A modification of the invention includes a securement strap arranged for securing the bottle fixedly to the mounting blocks, as well as a truncated conical cork receivable within the second diameter opening, with the cork including a coaxially arranged filter portion directed therethrough to effect filtering of smoke contained within the bottle. The organization may further include a forward semi-cylindrical support mounted within the forward saddle of the forward block to permit raising of the semi-cylindrical support to compensate for variously configured bottles positioned within the support blocks.

3 Claims, 4 Drawing Sheets

ASHTRAY APPARATUS

BACKGROUND OF THE INVENTION

1. Field of the Invention

The field of invention relates to ashtray apparatus, and more particularly pertains to a new and improved ashtray apparatus wherein the same includes a disposable bottle for permitting discarding of the bottle and associated cigarette debris contained within the bottle.

2. Description of the Prior Art

Various ashtray apparatus has been provided in the prior art to contain cigarette debris resulting from cigarette smoking. Examples of the prior art include U.S. Pat. No. 4,634,014 to Carr wherein a tray member is mounted to a top portion of a beverage container permitting disposing of the container and debris contained therewithin subsequent to a smoking event.

U.S. Pat. No. 4,349,036 to Harvey, et al. sets forth a further example of a disposable ashtray in a generally "X" shaped configuration utilizing a liner mounted within the "X" shaped support stand, wherein the liner may be disposed of subsequent to its use.

U.S. Pat. No. 4,726,472 to Su sets forth a disposable ashtray, with a body portion and corrugated tray formed out of tinned paper. The cigarettes may be placed slant-wise in the body portion without being extinguished, wherein the ashtray organization may be disposed of subsequent to use.

U.S. Pat. No. 4,776,352 to Chen sets forth a disposable ashtray and holder, wherein a plurality of secured sheets includes one mouth-like opening, including an integral tongue functioning as a platform for securing a cigarette therewithin, with a stand for supporting the sheets.

U.S. Pat. No. 4,027,683 to Lawbaugh sets forth an ashtray with a disposable liner, wherein the ashtray is in a bowl-shaped configuration with a liner including snuffing inserts mounted within the liner to permit snuffing of cigarettes.

As such, it may be appreciated that there continues to be a need for a new and improved ashtray apparatus as set forth by the instant invention which addresses both the problems of ease of use as well as effectiveness in construction in providing a disposable organization permitting disposal of cigarettes and debris therefrom subsequent to a smoking event and in this respect, the present invention substantially fulfills this need.

SUMMARY OF THE INVENTION

In view of the foregoing disadvantages inherent in the known types of disposable ashtray apparatus now present in the prior art, the present invention provides an ashtray apparatus wherein the same utilizes a bottle member mounted adjustably within spaced supports permitting disposal of the bottle subsequent to use. As such, the general purpose of the present invention, which will be described subsequently in greater detail, is to provide a new and improved ashtray apparatus which has all the advantages of the prior art disposable ashtray apparatus and none of the disadvantages.

To attain this, the present invention provides an ashtray apparatus mounting a disposable bottle, wherein the organization includes a forward and rear mounting block, with each mounting block including an aligned semi-cylindrical saddle to receive the bottle thereon. The bottle includes a first diameter and a forward end, with an opening of a second reduced diameter to receive a cigarette therewithin, wherein the cigarette is permitted to extenguish within the bottle upon prolonged positioning within the bottler permitting subsequent disposal of the bottle and cigarette debris. A modification of the invention includes a securement strap arranged for securing the bottle fixedly to the mounting blocks, as well as a truncated conical cork receivable within the second diameter opening, with the cork including a coaxially arranged filter portion directed therethrough to effect filtering of smoke contained within the bottle. The organization may further include a forward semi-cylindrical support mounted within the forward saddle of the forward block to permit raising of the semi-cylindrical support to compensate for variously configured bottles positioned within the support blocks.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved ashtray apparatus which has all the advantages of the prior art disposable ashtray apparatus and none of the disadvantages.

It is another object of the present invention to provide a new and improved ashtray apparatus which may be easily and efficiently manufactured and marketed.

It is a further object of the present invention to provide a new and improved ashtray apparatus which is of a durable and reliable construction.

An even further object of the present invention is to provide a new and improved ashtray apparatus which is susceptible of a low cost of manufacture with regard to both materials and labor, and which accordingly is then susceptible of low prices of sale to the consuming public, thereby making such ashtray apparatus economically available to the buying public.

Still yet another object of the present invention is to provide a new and improved ashtray apparatus which provides in the apparatuses and methods of the prior art some of the advantages thereof, while simultaneously overcoming some of the disadvantages normally associated therewith.

Still another object of the present invention is to provide a new and improved ashtray apparatus wherein the same provides for an organization accommodating variously configured bottles for their support with the organization permitting their use and subsequent disposal subsequent to a smoking event.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
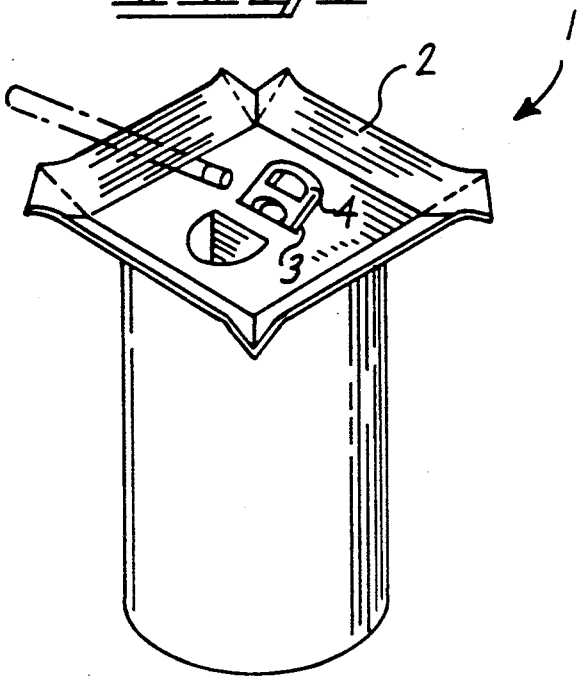
FIG. 1 is an isometric illustration of a prior art disposable ashtray apparatus.
Figure 2:
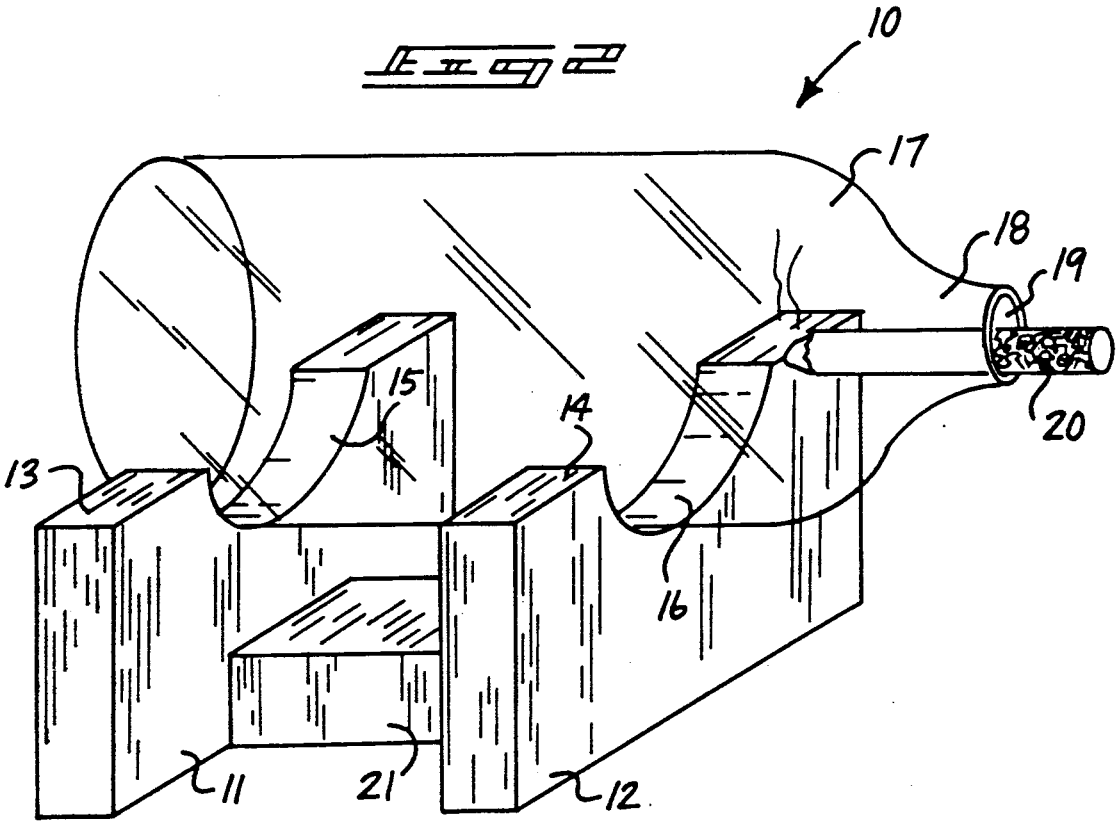
PRIOR ART FIG 2
FIG. 2 is an isometric illustration of the instant invention.

With reference now to the drawings, and in particular to FIGS. 1 to 8 thereof, a new and improved ashtray apparatus embodying the principles and concepts of the present invention and generally designated by the reference numeral 10 will be described.

FIG. 1 is an isometric illustration of a prior art disposable ashtray apparatus 1, wherein a tray member 2 is provided with a slot 3 to receive a tab 4 of an underlying container to position the tray overlying the opening of the container for receiving cigarette debris into the container, as illustrated and described in U.S. Pat. No. 4,634,014.

More specifically, the ashtray apparatus 10 of the instant invention essentially comprises a rear mounting block 11 parallel a forward mounting block 12. The mounting blocks include a respective rear mounting wall top block 13 and a forward mounting block top wall 14. The top walls each include a respective saddle defined by a rear semi-cylindrical saddle 15 and a forward semi-cylindrical saddle 16 that are coaxially aligned relative to one another to receive an elongate bottle thereon defined by a predetermined length substantially equal to or greater than a saddle length defined between the spaced rear and forward saddles 15 and 16. The bottle 17 is of a conventional configuration of a first diameter, with a tapered neck portion 18 directed into a bottle opening 19 of a second diameter less than the first diameter. A cigarette member 20 is positioned within the bottle opening 19 to permit debris to accumulate within the bottle or permit extinguishment of the cigarette member 20 upon prolonged positioning within the bottle 17, as illustrated in FIG. 1. Subsequent to use, the bottle 17 may be discarded with a further bottle positioned within the saddles 15 and 16. It should be noted that a connecting block 21 orthogonally and integrally joined to a forward wall of the rear mounting block 11 and a rear wall of the forward mounting block 12 joins and positions the mounting blocks in the spaced parallel relationship, as noted.

Figure 3:
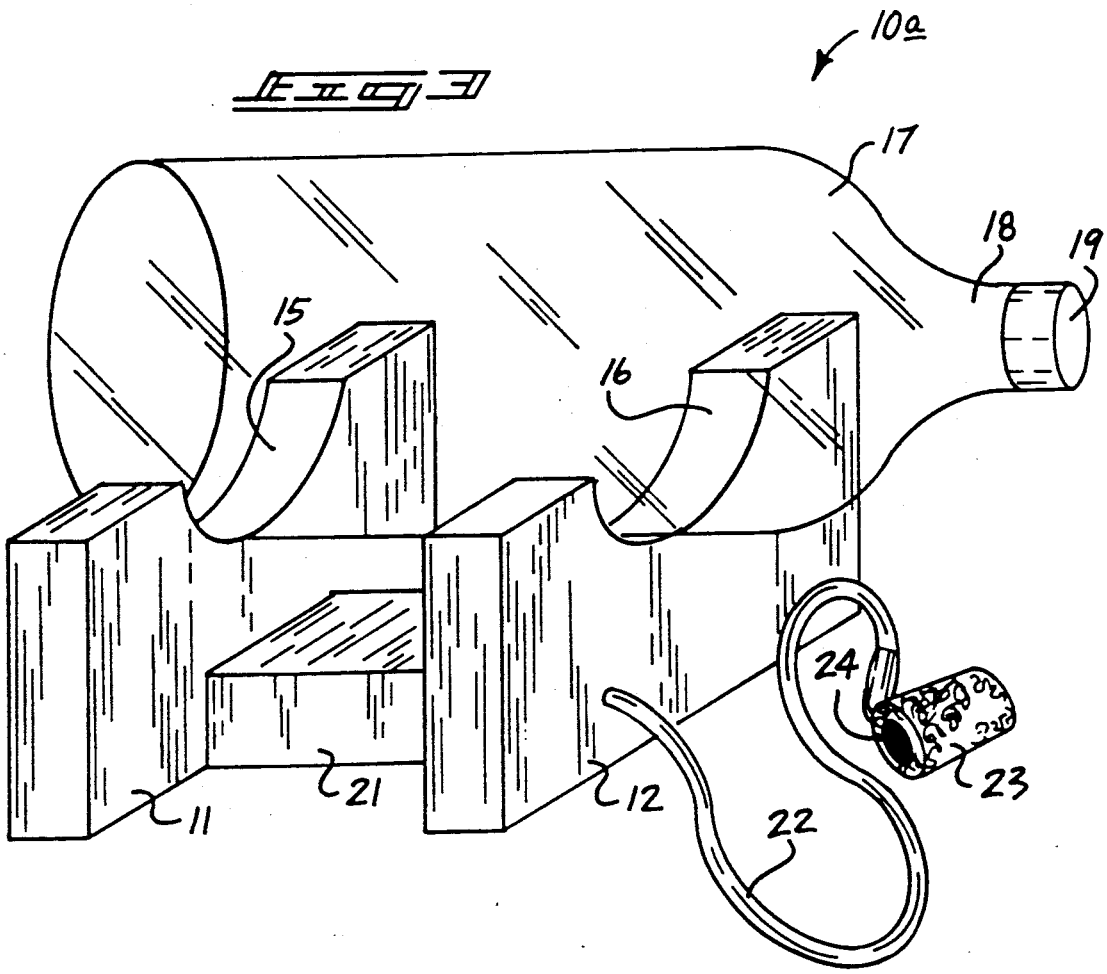
FIG. 3 is an isometric illustration of the instant invention utilizing a cork and filter member positionable within the opening of the bottle.

FIG. 3 illustrates a modified apparatus 10*a*, wherein a tether line 22 is fixedly mounted to a forward wall of the forward mounting block 12, and includes a truncated conical cork member 23 mounted at a forward end of the tether line spaced from the mounting block, wherein the cork is arranged for securement within the bottle to contain the components therewithin between interval use of the bottle in various smoking events. A coaxially positioned filter member 24 is directed throughout the cork member 23 to permit exchange of air within the bottle to minimize offensive odors emanating therefrom when the cork member is removed.

Figure 4:
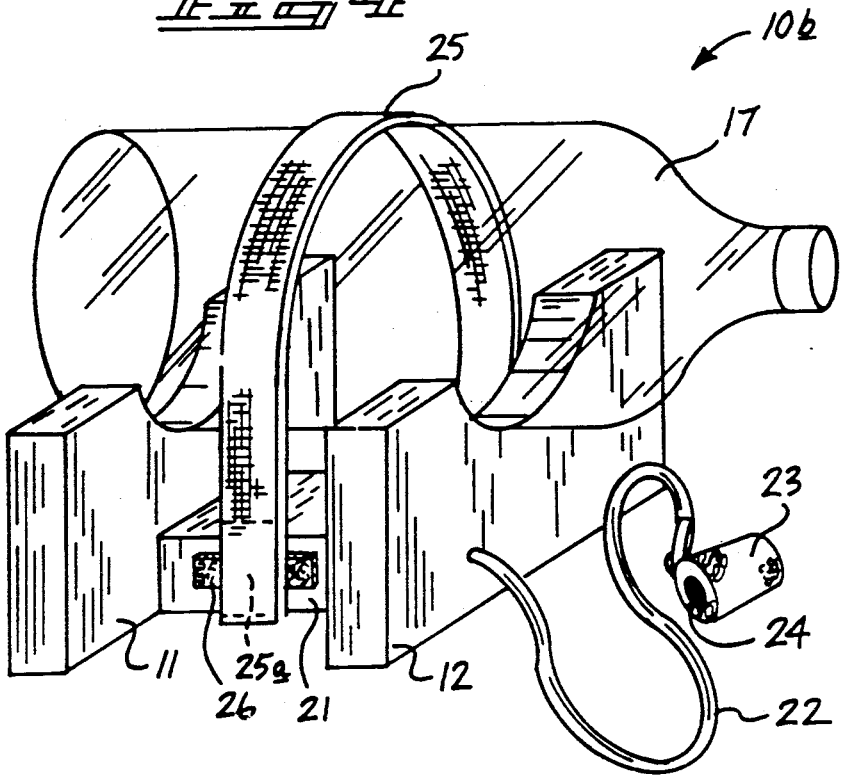
FIG. 4 is a further modified isometric illustration of the instant invention utilizing a securement strap to ensure fixed positioning of the bottle within the support organization.
Figure 5:
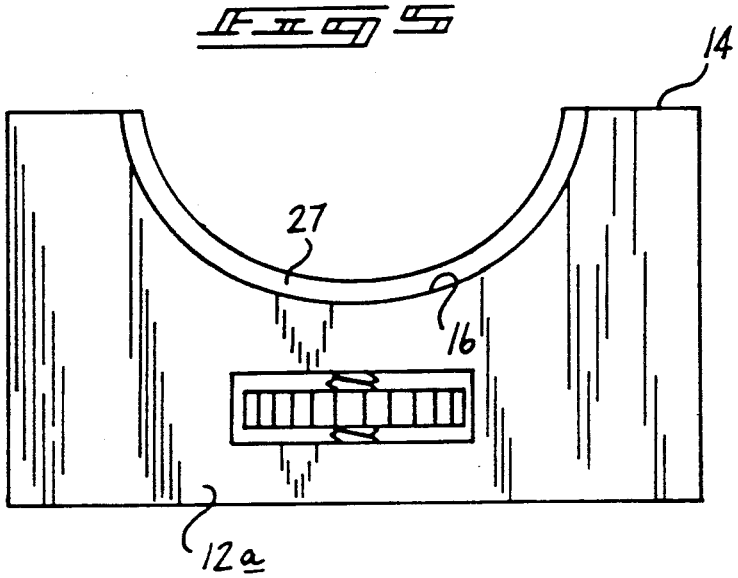
FIG. 5 is an orthographic front view, taken in elevation, of a modified front support utilizing an adjustable semi-cylindrical support.
Figure 6:
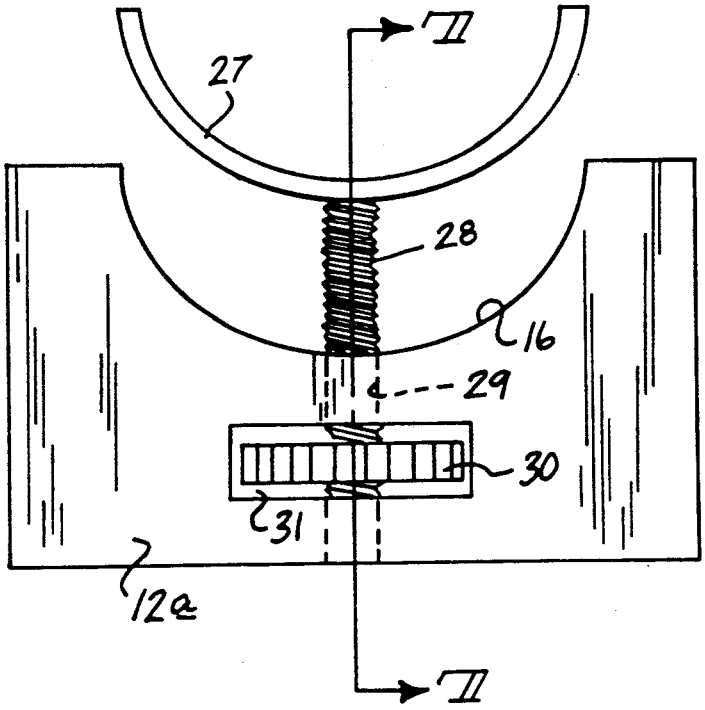
FIG. 6 is an orthographic frontal view, taken in elevation, of the semi-cylindrical support in an elevated configuration.
Figure 7:
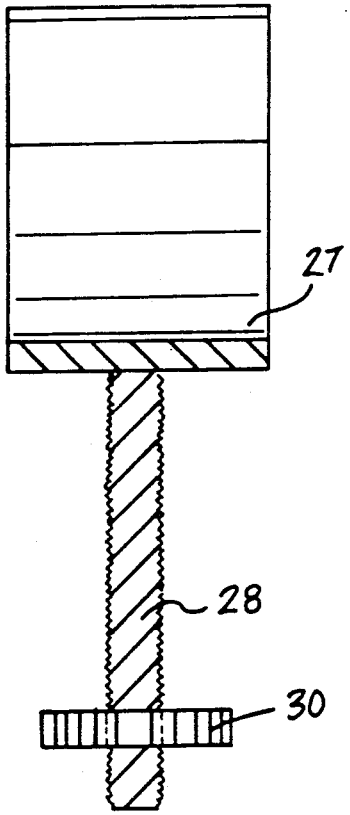
FIG. 7 is an orthographic view of the semi-cylindrical support and mechanism, taken along the lines 7—7 of FIG. 6 in the direction indicated by the arrows.

FIG. 4 illustrates a modified ashtray apparatus, wherein additionally the organization includes a circumferential securement strap 25 that is mounted to a first side of the connecting block 21 and is secured to a block hook and loop surface 26 mounted to a second side of the connecting block 21. The circumferential securement strap 25 includes a strap hook and loop fastener surface 25*a* directed through an interior surface of the strap of a greater length than a contacting width defined by the block hook and loop fastener surface 26 to permit circumferential adjustment of the strap 25 about an associated bottle 17 to accommodate bottle 17 of varying diameters.

Figure 8:
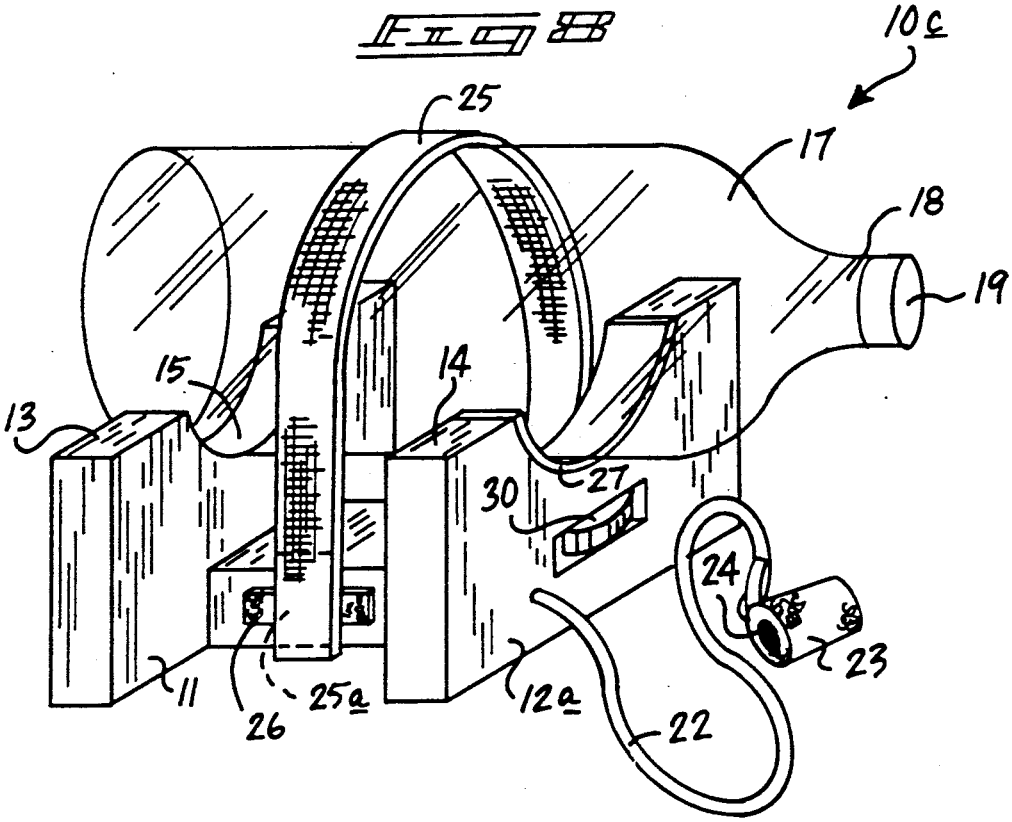
FIG. 8 is an isometric illustration of the modified invention utilizing the securement strap, the filtration plug, and the adjustable front support.

FIG. 8 illustrates the use of the organization 10*c*, including a semi-cylindrical support 27 (see FIGS. 5, 6, and 7) that includes a threaded support rod 28 fixedly and medially mounted to a bottom surface of the semi-cylindrical support 27, wherein the semi-cylindrical support complementarily receiving within the forward semi-cylindrical saddle 26. The threaded support rod 28 is received within an alignment bore 29 within a modified forward mounting block 12*a*, with a through-extending slot 31 directed orthogonally through the block 12*a* underlying the saddle 16 and receiving a rotatable thumb wheel 30 that threadedly receives the support rod 28 coaxially therethrough. Accordingly, rotation of the thumb wheel 30 effects a lifting or retraction of the semi-cylindrical support 27 relative to the forward saddle 16 to accommodate bottles of varying configurations, as required.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An ashtray apparatus comprising, in combination, a rear mounting block spaced from a forward mounting block, the rear mounting block includes a rear semi-cylindrical saddle, and the forward mounting block includes a forward semi-cylindrical saddle, wherein the rear and forward semi-cylindrical saddles are coaxially aligned relative to one another, and the rear and forward saddles are spaced apart a predetermined spacing, and an elongate bottle defined by a predetermined length substantially equal to or greater than the predetermined spacing mounted upon the rear and forward saddle, and wherein a connecting block is orthogonally mounted to a forward wall of the rear mounting block and orthogonally mounted to a rear wall of the forward mounting block to maintain the rear and forward saddles in the predetermined spacing, and including a tether line fixedly mounted to the forward mounting block at a rear terminal end of the tether line, and the forward end of the tether line fixedly mounted to a truncated conical cork member, the cork member including a coaxially directed filter member directed coextensively through the cork member for securement within an opening of the bottle.

2. An apparatus as set forth in claim 1 wherein the connecting block includes a first side and a second side, a circumferential securement strap mounted to the first side, and the second side including a block hook and loop fastener surface defined by a predetermined width, the securement strap including a strap hook and loop fastener surface defined by a strap length greater than the predetermined width to secure the bottle on the forward and rear saddles.

3. An apparatus as set forth in claim 2 wherein a semi-cylindrical support is complementarily mounted removable within the forward saddle, the semi-cylindrical support includes a threaded support rod orthogonally and medially mounted to a bottom surface of the semi-cylindrical support, the threaded support rod received through an alignment bore directed through the forward mounting block, and the forward mounting block including a through-extending slot directed orthogonally through the forward mounting block orthogonally arranged relative to the alignment bore, and the through-extending slot including a thumb wheel positioned within the through-extending slot, the thumb wheel threadedly receiving the support rod coaxially through the thumb wheel to permit rotation of the thumb wheel and relative positioning of the semi-cylindrical support relative to the forward mounting block to accommodate further bottles of various configurations mounted upon the rear saddle and the semi-cylindrical support.

* * * * *